United States Patent [19]

Lemke

[11] 4,214,944

[45] Jul. 29, 1980

[54] ADHESIVE BONDING OF ASSEMBLY PARTS

[75] Inventor: Harold C. Lemke, Grayslake, Ill.

[73] Assignee: American Can Company, Greenwich, Conn.

[21] Appl. No.: 908,752

[22] Filed: May 23, 1978

[51] Int. Cl.[2] ..... B32B 31/00; B65D 17/26

[52] U.S. Cl. ..... 156/518; 56/521; 156/530; 220/274

[58] Field of Search ..... 156/518, 530, 521; 220/274

[56] References Cited

U.S. PATENT DOCUMENTS

| | | | |
|---|---|---|---|
| 2,107,311 | 2/1938 | Strickler | 156/521 X |
| 2,157,556 | 5/1939 | Menschner | 156/518 |
| 3,747,691 | 7/1973 | Lundman et al. | 173/119 |
| 3,823,050 | 7/1974 | La Mers | 156/518 X |
| 3,924,692 | 12/1975 | Saari | 173/119 X |

*Primary Examiner*—William A. Powell
*Assistant Examiner*—L. E. Rodgers
*Attorney, Agent, or Firm*—Robert P. Auber; Ira S. Dorman; George P. Ziehmer

[57] ABSTRACT

One assembly part is bonded to another by a patch separated from an adhesive strip by a piercing punch after which the separated patch is applied to the assembly parts in a controlled, conformed manner by a bonding punch which may be coaxial with the piercing punch.

3 Claims, 7 Drawing Figures fig.1.
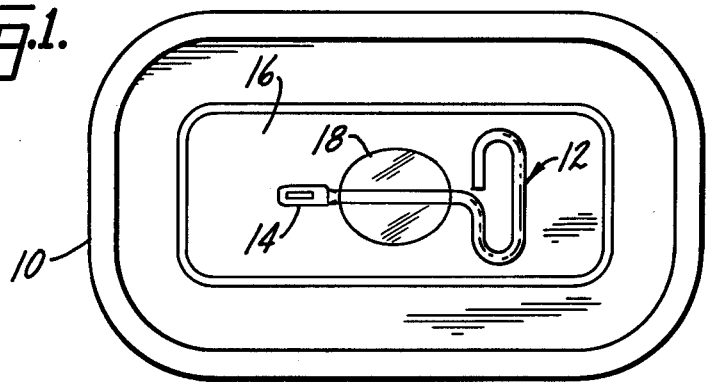
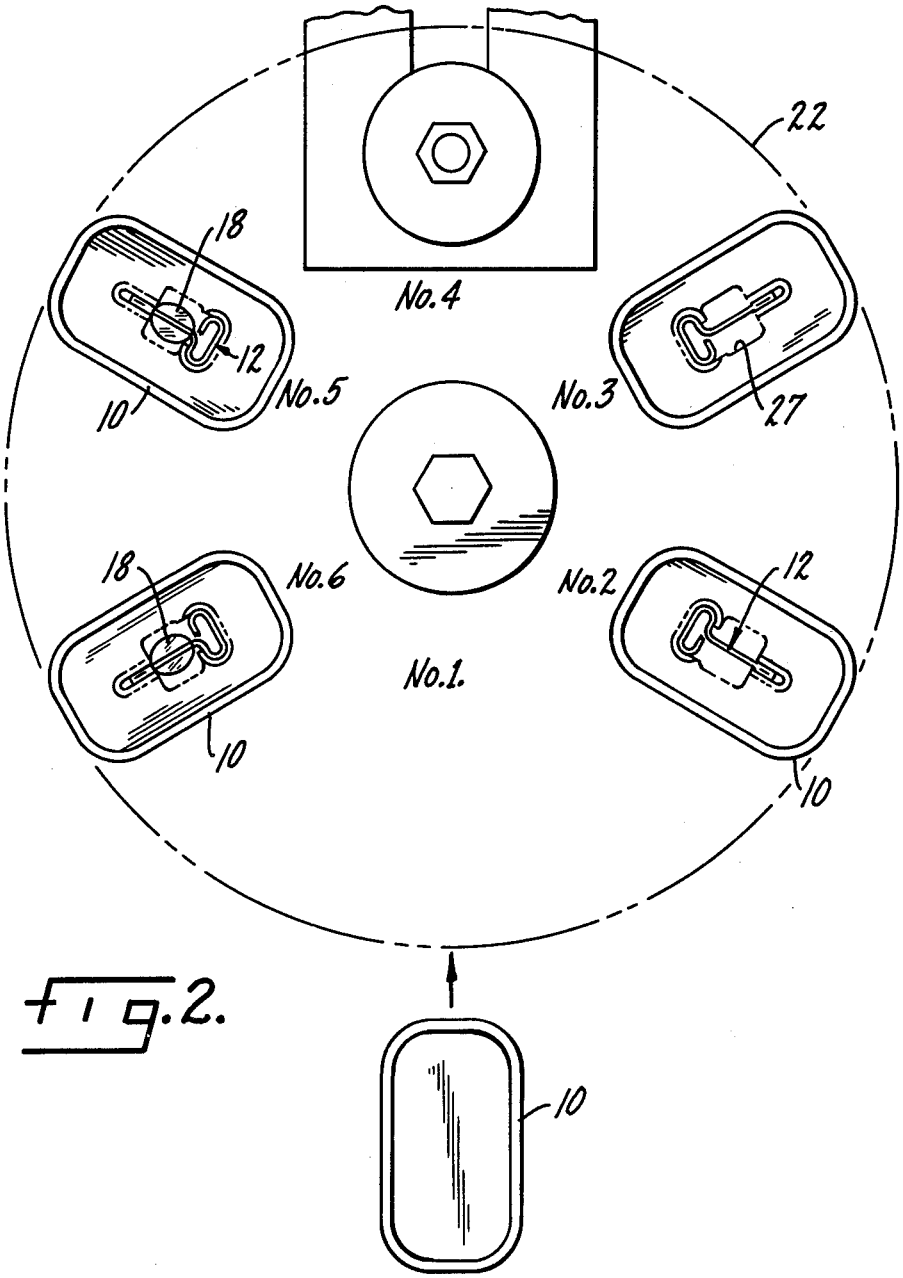
fig.2.

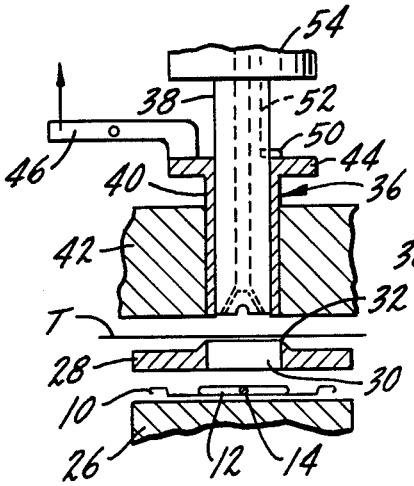
fig.3.
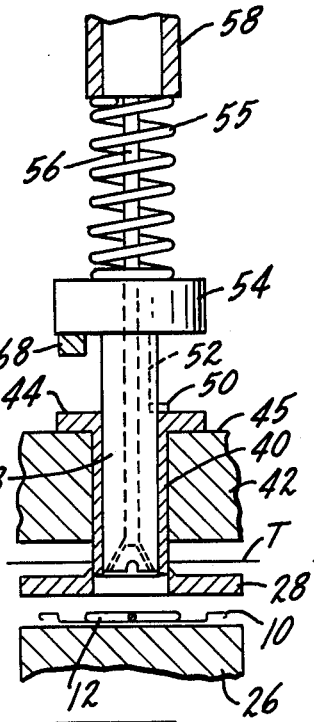
fig.4.
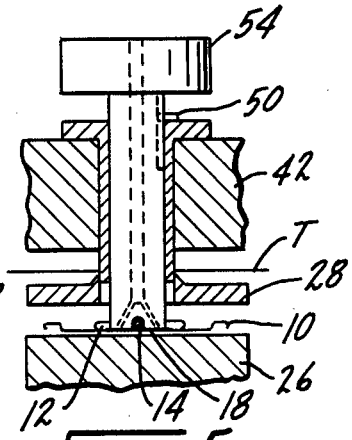
fig.5.
fig.7.
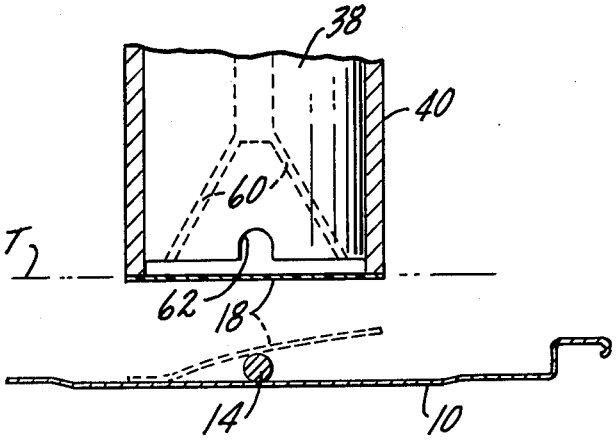
fig.6.
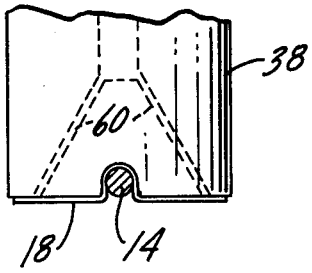

ADHESIVE BONDING OF ASSEMBLY PARTS

This invention relates to a method and apparatus for separating a patch from a strip of adhesive and using the patch to hold one assembly part to another part.

The present invention was prompted by a consideration of whether a more advantageous way could be found to hold an opener key on a food container (e.g. the slotted key on a can of sardines) other than by spot welding as is commonly done. The spot weld is difficult to control and consequently there are losses in time and material. If the weld spot is too hot, the container end wall is burned through and must be discarded; if the weld spot is cold, the key may easily come loose. Also there are combinations of materials where one part cannot be easily spot welded to a second part, which may be of a different material.

The present invention is concerned with an efficacious way of fastening an opener key to a container surface by an adhesive bond, and the preferred mode of practice will be disclosed as applied thereto; however, the present invention can doubtless be used to bond other assembly parts as well.

In the drawing

FIG. 1 is a plan view of a container end having an opener key bonded thereto in accordance with the present invention;

FIG. 2 is a diagrammatic view of the stages of assembly showing the template in phantom;

FIGS. 3, 4 and 5 are sectional views, somewhat schematic, showing apparatus constructed in accordance with the present invention and showing the template in solid lines;

FIGS. 6 and 7 are views on an enlarged scale showing the preferred manner in which the bond is effected.

In FIG. 1 of the drawing, the end piece of a container 10 is provided with a slotted opener key 12 having a slotted shank 14 for opening the container in a well-known manner. The key is located in a recess 16 and in accordance with the present invention the key is retained on the container end 10 by an adhesive patch 18.

The procedure for assembly is shown diagrammatically in FIG. 2. The container end or lid 10 is fed to station No. 1 on a turret 22. At station No. 2, the key 12 is associated with the container end 10. Station No. 3 is an idle position and at station No. 4 the adhesive patch is applied to hold the key on the container end.

Station No. 5 may be an idle position but preferably the applied patch 18 is "bumped" at station No. 5 by a tool (not shown) to assure further conformance of the patch to the profile of the key shank and adjacent surfaces of the container end with which it is in bonding contact already. The bumping tool may be like the bonding punch hereinafter described or may have a resilient end to conform to the patch applied at station No. 4.

At station No. 6 the container end with the key attached thereto is discharged.

The present invention, for the most part, is concerned with the apparatus located at station No. 4 and will now be described.

The portion of the key to be bonded to the container end is the shank portion 14 between the head of the key and the slotted end. As shown in FIG. 3, the container end 10 is located on an anvil 26 included in the turret assembly and in this connection it may be mentioned that the key is accurately located by a template 27, FIG. 2.

A die 28 having an aperture 30 is juxtaposed in spaced relation to the key so the key shank 14 is aligned with the aperture 30. Aperture 30 is provided with a sharp cutting edge 32 and of course the die occupies a fixed position at station No. 4.

Positioned above the aperture 30 of die 28 is a piercing punch and bonding punch assembly 36. The two punches are coaxially related so that the bonding punch 38, in the form of a cylinder, is positioned in guiding relation inside the piercing punch 40 which is of tubular form. The piercing punch 40, in turn, is located in an opening of a fixed holder or guide 42 at station No. 4.

The effective, working end of the piercing punch 40 is circular and the outside diameter is complemental to the inside diameter of aperture 30 in the die 28.

The circular or disc-shaped adhesive patch is separated from an endless adhesive strip T having a coating of adhesive restricted to the side of the tape T facing the die aperture 30. To separate the circular patch from the strip T, the two punches are initially advanced together, moving from the position shown in FIG. 3 to the position shown in FIG. 4 where the piercing punch has penetrated the die aperture thereby to separate the patch. The piercing punch is stopped in a manner to be described and thereafter the bonding punch advances independently through the die aperture to transfer the separated patch into contact with the shank of the key and the surfaces of the container end 10 adjacent thereto.

The working or advancing stroke of the piercing punch 40 is fixed and determined by a flange 44 at the end of punch 40 opposite the working end. This flange is normally spaced from a stop surface 45 presented by the guide member 42. The piercing punch may be advanced through its working stroke by a bell crank lever 46, FIG. 3, which has the effective end thereof in contact with flange 44.

In order that the two punches will advance together during the effective stroke of the piercing punch, the flange 44 is provided with a pin 50 having one end disposed in a key slot 52 in the cylinder 38 which constitutes the bonding punch. Consequently, when lever 46 is pivoted in the clockwise direction, FIG. 3, the two punches advance together. At the end of this advancing stroke the circular patch has been separated from tape T and the working end of the bonding punch 38, FIG. 4, has slightly penetrated the die aperture.

After the tape T has been pierced to separate the patch 18, the bonding punch is advanced independently through its working stroke by a downward force applied to a ram head 54 attached to the upper end of the bonding punch. This downward force is preferably exerted by a strong coil spring 55 loosely mounted on a guide 56, secured to ram head 54, with its lower end in contact with ram 54. In turn the operating force for the bonding punch is applied by a yoke 58 engaged with the upper end of spring 55.

The bonding adhesive is very strong and quite tacky and for this reason it is necessary to have the patch under control once it is separated by the piercing punch. Referring to FIG. 6, the patch 18 has been separated from tape T by the piercing punch 40. It the patch 18 were allowed to drift or drop onto the key shank 14, or even advanced further by piercing punch 40, there can be no assurance that the patch 18 will effectively capture the key shank 14; indeed the patch 18 may "drift" in an uncontrolled fashion as shown by the dashed line which identifies the unacceptable condition for the patch 18.

Accordingly, a means is provided to hold the separated patch 18 taut across the operating end of the bonding punch and this may be conveniently achieved by passages 60, FIGS. 6 and 7, within the bonding punch, communicating negative atmospheric pressure (vacuum) from a source not shown to the operating end of the piercing punch for holding the separated patch 18 in a taut condition; additionally, the operating end of the bonding punch is provided with a recess 62 complemental to the section of the key shank 14.

By thus effectively holding the patch 18 to the end of the bonding punch and providing the end of the bonding punch with a recess complemental to the key shank, the patch 18, at the time the patch is presented to the key shank 14, is tailored or conformed to the section of the key shank.

It has been mentioned the working stroke imparted to the bonding punch is applied through spring 55. The end of the effective stroke of punch 38 is shown in FIG. 5. By employing a cam (not shown) to operate yoke 58 a slight dwell time may be imparted to the bonding punch at the end of its downward stroke as the spring force is being exerted on the patch transferred to the assembly parts 10 and 14.

After the patch has been applied to the assembly parts, the bonding punch is returned to its retracted position. This may be accomplished by a cam-operated lever or finger 68. When the shoulder of slot 52 is represented to pin 50 the piercing punch is restored during the remainder of the return stroke imparted by lever 68.

The patch 18 of course is sized to straddle the key shank 14 with wing portions of the patch in bonding contact with the adjacent surfaces of the container end 10. The recess 62 in the working end of the bonding punch 38 and the flat surrounding surface conform the patch, respectively, to the profile of the key shank and the adjacent surfaces of part 10. It would be possible to achieve conformance another way, as by having a resilient pad or shoe at the end of the bonding punch, but the recess 62 in the metal end of punch 38 assures permanence in the sense of a wear resistant punch end so that a constant spring force (spring 55) can be calculated and relied on for long time service.

The vacuum is relatively weak and is constantly applied, sufficient to hold the patch taut and centered as it is forced on to the key but insufficient, of course, to overcome the bonding force of the adhesive on the patch once applied.

After one patch is applied at station No. 4 and the punches returned to the position shown in FIG. 5, the turret 22 is indexed to present the next assembly to be bonded, the tape T is advanced one step, and so on continuously.

I claim:

1. Apparatus for separating an adhesive patch from an adhesive strip and for applying the patch to an opener key on a container lid, comprising:

an indexable turret having an anvil for supporting the lid;

a template for locating the key on the lid;

a coaxial piercing punch and bonding punch supported for movement independently of one another above the turret, each punch having a working end respectively for separating the patch and applying the patch to the key on the lid;

a die member opposed to the piercing punch and having an aperture therein presenting a cutting edge for separating a patch from an adhesive strip positioned between the die member and the working ends of the punches, the patch being so sized to straddle and overlap the key on the lid;

means for actuating the piercing punch to separate said so sized patch from said strip with the cooperation of said cutting edge;

said bonding punch having passages supplied with negative atmospheric pressure to hold the separated patch in holding position on the end of the piercing punch until the patch is transferred to the key by the bonding punch;

and means for actuating the bonding punch independently of the piercing punch to advance the working end thereof through said aperture to force and transfer the separated patch from its holding position on the piercing punch into bonding contact with the key on the anvil-supported lid.

2. Apparatus according to claim 1 in which the working end of the bonding punch is recessed to conform to the profile of the portion of the key bonded by the patch.

3. Apparatus according to claim 1 in which the piercing punch is a sleeve and in which the bonding punch is a cylinder inside said sleeve, a fixed guide member is provided in which the sleeve is positioned, said sleeve having a stop flange opposed to a surface on the guide member to limit the stroke of the piercing punch.

* * * * *